United States Patent [19]

Kerley, Jr.

[11] 4,369,061

[45] * Jan. 18, 1983

[54] RECOVERY OF PRECIOUS METALS FROM DIFFICULT ORES

[76] Inventor: Bernard J. Kerley, Jr., Santo Tomas Rt. Box 73, Sahuarita, Ariz. 85629

[ * ] Notice: The portion of the term of this patent subsequent to May 26, 1998, has been disclaimed.

[21] Appl. No.: 200,057

[22] Filed: Oct. 20, 1980

Related U.S. Application Data

[63] Continuation-in-part of Ser. No. 108,168, Dec. 28, 1979.

[51] Int. Cl.[3] ..... C22B 11/04

[52] U.S. Cl. ..... 75/103; 75/118 R; 75/121; 423/32; 423/33; 423/514

[58] Field of Search ..... 75/103, 118 R, 121; 423/32, 33, 514

[56] References Cited

U.S. PATENT DOCUMENTS

| | | | |
|---|---|---|---|
| 2,219,258 | 10/1940 | Hill | 423/514 |
| 3,843,771 | 10/1974 | Urban | 423/514 |
| 4,070,182 | 1/1978 | Genis-Sas-Berezowski et al. | 423/32 X |
| 4,269,622 | 5/1981 | Kerley, Jr. | 423/32 X |

*Primary Examiner*—G. Peters

*Attorney, Agent, or Firm*—Browdy and Neimark

[57] ABSTRACT

Precious metals such as gold and silver are recovered from difficult-to-treat ores, particularly those containing manganese, by lixiviating using an ammonium thiosulfate leach solution containing copper, sufficient ammonia to maintain a pH of at least 7.0, and at least 0.05% sulfite ion, sulfite and thiosulfate requirements being maintained by the reaction in situ of sulfur dioxide and elemental sulfur.

6 Claims, No Drawings

RECOVERY OF PRECIOUS METALS FROM DIFFICULT ORES

This is a CIP application of parent copending application Ser. No. 108,168, filed Dec. 28, 1979.

FIELD OF INVENTION

The present invention relates to the recovery of minerals from ores and, more particularly, to the extraction of precious metals by lixiviation, particularly from ores which are otherwise difficult to handle.

BACKGROUND OF THE INVENTION

Lixiviation is a technique used to extract a soluble component from a solid mixture by washing or percolation, i.e. leaching. World-wide practice for extracting precious metals by lixiviation is carried out using cyanide solutions, mainly sodium cyanide. Because cyanides are so highly toxic, and because they cause substantial environmental problems, the use of cyanides is now falling into disfavor. Moreover, cyanides are costly materials which makes their use economically disadvantageous. Moreover, the use of cyanide solutions is at best difficult and at worst impossible with respect to some ores, especially those containing copper and/or manganese, since these materials easily contaminate the cyanide; and such materials are frequently present to the extent that high reagent loss is experienced along with poor recoveries of the precious metals.

Indeed, with respect to the last problem mentioned immediately above, there are many difficult-to-treat ores in existence which contain manganese, copper oxides and significant quantities of silver and/or gold, and from which it would be desirable to extract these precious metals, if a suitable and sufficiently inexpensive technique existed for such recovery. However, present techniques are simply not adequate and these ores remain an untapped mineral resource.

Copper sulfide containing ores, such as calcocite and chalcopyrite, often contain small quantities of gold and silver which, desirably, should be recovered. Although the problem of recovering such precious metals, as well as the copper, has received considerable attention in the past, much of the work carried out in this connection, insofar as commercial processing is concerned, has involved the recovery of precious metals using pyrometallurgical processes for the recovery of the copper.

One attempt to solve the above identified problems is disclosed in the Genik-Sass-Berecowsky et al U.S. Pat. No. 4,070,182. This patent proposes the use of ammonium thiosulfate as a secondary leach for the recovery of silver and gold, in conjunction with a hydrometallurgical process for the recovery of copper from the copper-bearing sulfidic ore. FIG. 3 of this patent shows a flow diagram for the extraction of precious metals from chalcopyrite concentrate before the main leaching step for extraction of copper. However, this patent appears to provide no instruction as to how to maintain the thiosulfate radical stable, and does not even appear to recognize the problem of thiosulfate instability; a time-related instability, causing loss in recovery, is mentioned but no reason is suggested or solution proposed. The treatment of raw ores most generally requires more time for satisfactory recovery than is allowed in treating the sulfidic concentrates or residues as described in this patent.

This patent also does not clearly teach the necessity of maintaining an alkaline pH in the thiosulfate leach liquor when starting with a raw ore, although the need for an alkaline pH is mentioned in conjunction with thiosulfate extraction following a copper recovery leach. Furthermore, this patent provides no guidance with respect to the extraction of precious metals from difficult raw untreated ores, and more importantly ores containing manganese.

SUMMARY OF THE INVENTION

It is, accordingly, an object of the instant invention to overcome deficiencies in the prior art, such as indicated above.

It is another object to provide for the improved extraction of precious metals from ores by lixiviation.

It is a further object to provide an improved process of extracting precious metals, such as gold and silver, by lixiviation, using an ammonium thiosulfate leach liquor.

It is yet another object of the instant invention to provide for the extraction of precious metals from difficult-to-treat ores, and particularly such ores containing copper, arsenic, antimony, selenium, tellurium and/or manganese, and most particularly such ores containing manganese.

It is yet a further object to provide a method for recovery of precious metals from am ore containing same, which method comprises lixiviating the precious metals, using an ammonium thiosulfate leach liquor at an alkaline pH and containing copper and sulfite ions.

It is yet another object of the instant invention to provide a method for the lixiviation of precious metals wherein the necessary leaching reagent, for example ammonium thiosulfate, is produced in situ using only elemental sulfur as raw material, the other principal reagents, ammonia and copper, being recycled for reuse with only very small amounts of makeup being required.

These and other objects and the nature and advantages of the instant invention will be more apparent from the following detailed description of various embodiments, such detailed description being offered illustratively and not limitatively.

DETAILED DESCRIPTION OF EMBODIMENTS

In accordance with the instant invention, it has been found that the problems exstant in the prior art, including those indicated above, are largely overcome by lixiviation in ammonium thiosulfate solutions containing copper and at least a trace of sulfite ions. With the use of such a leach liquor good recoveries are achieved in less time compared with the prior art use of cyanide, and without the possibility of contamination of streams and surroundings with such highly toxic cyanide. Moreover, the process constitutes an improvement of the thiosulfate leaching of U.S. Pat. No. 4,070,182 by providing better control of the stability of the thiosulfate radical.

After the lixiviation has been completed, recovery of the precious metals from the leach liquor can be carried out in the same ways as are conventionally used for recovering such metals from cyanide solutions, namely the use of metallic zinc, iron or copper; by electrolysis; or by the addition of soluble sulfides to recover a sulfide precipitate. The stripped ammonium thiosulfate solution is thereby rejuvenated and can be recycled for reuse in the instant process.

The present process is especially advantageous for the recovery of precious metals from difficult-to-treat ores, namely those which are contaminated by copper, arsenic, antimony, selenium, tellurium and/or manganese, and possibly other base metals as well. Copper and manganese, and particularly manganese, are especially poisonous to cyanide solutions, and because thiosulfate is much less expensive, stronger leach solutions may be used, which will overcome the disadvantages of such poisons as manganese and lead. A particular problem exists with manganese ores, as many such ores presently exist which, under previous technology, are simply unusable. The instant invention overcomes the disadvantages of high manganese content, and good recoveries are obtained merely at the expense of the use of more reagent and, at times, maintaining a higher quantity of sulfite in the leach solution than would otherwise be needed in accordance with the instant invention.

In any lixiviation process, the strength of the leach solution is an important consideration. However, with cyanide lixiviation the high toxicity and the high cost of the chemical prohibit consideration of using more than about 1-2% solutions, thereby requiring long retention times and resultant large capacity solution tanks. These problems are eliminated by the instant invention; thus, in the present invention ammonium thiosulfate, which is a relatively low cost and non-toxic material, can be used in much stronger solutions than is permissible with cyanide, namely as high as 60%. Solutions in the range of 12-25% are particularly satisfactory, it being understood that the higher the solution strength the less the time needed for completing the leaching. In some ores, as little as 2% ammonium thiosulfate gives adequate results.

An important aspect of the present invention is the inclusion of copper in the leach solution or lixiviation liquor. This, of course, presents no problem if the ore itself contains copper, such as the ores treated in accordance with U.S. Pat. No. 4,070,182. Some copper must be present for good recovery, and if the ore itself contains copper, this will most generally suffice. If not, a copper salt or copper containing ore should be added to supplement and maintain the concentration required for best results. In general, and consistent with U.S. Pat. No. 4,070,182, it has been found that a copper concentration of 1-4 g/l is desirable, although this will vary somewhat from ore to ore.

Another important requirement is to maintain the pH of the leach solution in the alkaline range, preferable at least 7.0 and most preferably at least 8. Ammonium hydroxide (ammonia titratable with dilute standard acid) is the preferred means for maintaining the desired pH. Available ammonia not only accelerates the rate of solution of the precious metal in the leach liquor, but also helps to stabilize the ammonium thiosulfate.

The presence of sulfite ions in the leach solution is an essential aspect of the invention. The sulfite ion is necessary to inhibit the decomposition of the thiosulfate which, if permitted to occur, would result in precipitation of silver sulfide with resultant loss of recovery. While the quantity of sulfite present need not be great, as noted below, it is essential that the sulfite be present throughout the lixiviation process. Quantities as little as trace amounts of sulfite will assure stability of the solution, but in view of the continuously changing conditions which inherently occur in the lixiviation process, it is desirable that the sulfite ion be present in a quantity of at least 0.05%. In the case were the ores being treated are refractory ores, in particular ores containing significant quantities of manganese, an addition of up to three or four percent, e.g. 1-4%, of sulfite ions are desirable to accelerate the reaction and maintain stability of the ammonium thiosulfate.

Sulfite ions can be provided in a number of ways. The simplest and most direct way is by simply adding ammonium sulfite or ammonium bisulfite to the leaching solution; other sulfite salts may also be used. But the above procedure is not preferred. Instead, it is preferred to maintain sulfite concentration by generation of sulfite in situ, along with generation in situ of thiosulfate as will be described below. For example, in some cases as will be described in more detail below, it is most desirable to maintain sulfite concentration by adding sulfur dioxide to the ammoniacal leach solution, but if this method is chosen, precaution must be taken to assure that the solution does not become acid and that the pH is preferably maintained at 8 or above, it being understood that sulfur dioxide is an acid source.

The importance of maintaining at least a trace of sulfite anion ($SO_3^{--}$) in the leaching liquor during lixiviation is important because without the presence of sulfite, the thiosulfate radical becomes unstable resulting in the production of sulfide and the precipitation of silver as represented by the following equation:

$$CaO + (Ag)_2S_2O_3 \rightarrow Ag_2S + CaSO_4 \quad (1)$$

This equation is representative of the irreversible reactions which take place not only in the presence of calcium oxide, but also with the oxides of iron, aluminum, manganese and copper; and such a reaction may even take place with ammonium hydroxide in the absence of the sulfite anion. The sulfite ion prevents the formation of any free divalent sulfur which would undesirably cause the precipitation of silver, and automatic entrainment and loss of gold. In treating raw ores containing oxides of the metals listed above which serve to poison the extraction process, particularly manganese, the conditions are quite variable depending on the ore and thus it is essential to prevent decomposition of the thiosulfate following the general mechanism of formula (1) above. Maintaining at least a trace of sulfite ion, preferably at least 0.05% and most preferably 0.1-2% sulfite ion, has been found to stabilize the thiosulfate and thereby prevent precipitation of already dissolved precious metal.

An equilibrium reaction occurs in the thiosulfate leach liquor as represented by the following equation (2):

$$6H^+ + 4SO_3^{--} + 2S^{--} \rightleftarrows 3S_2O_3^{--} + 3H_2O \quad (2)$$

It is clear that without the sulfite ion being present, the equilibrium would move to the left, thereby producing divalent sulfide sulfur ($S^{--}$) which precipitates metal sulfides thereby losing them from the leaching solution. Equilibrium reaction (2) thereby readily illustrates the need for continued presence of some sulfite to drive the reaction (2) to the right thereby preventing the decomposition of the thiosulfate with loss of not only reagents but loss of values from the leaching solution.

Manganese containing precious metal ores have an unusually high requirement for sulfite ion, because of the oxidizing capability of various manganic compounds, especially prevalent among which is manganese dioxide ($MnO_2$). This high requirement for sulfite is demonstrated by equation (3) below:

$$MnO_2+2(NH_4)_2SO_3+2H_2O \rightarrow MnS_2O_6+4NH_4OH \quad (3)$$

The reaction demonstrated by equation (3) is beneficial with many ores, because the metals are in a complex combination with manganese, and such reaction serves to free the desirable metals from the manganese so that such desirable metals can then be lixiviated. However, the undesirable aspect of this reaction is that it consumes sulfite anion and it is therefore important that when acting on manganese containing ores in accordance with the present invention, special precautions be taken to assure the continued presence of sulfite thereby preventing equation (2) from going to the left with the resultant loss of these desired precious metals from the leaching solution.

The lixiviation is preferably carried out at a temperature of 40°-60° C. Temperatures much greater than 60° C. make it difficult to retain the ammonium hydroxide needed for best results. Temperatures below 40° C. adversely affect the speed of the process, i.e. the time it takes for the desired precious metals to become solubilized is undesirably extended; nevertheless, lower temperatures may be used as added time will make up for the lower temperatures and will suffice where the addition of heat is uneconomical.

As noted above, after recovery of the dissolved precious metals, such as by precipitation from the leaching liquor, the ammonium thiosulfate containing liquor is desirably recycled for reuse. However, there are likely to be certain losses of chemicals, including thiosulfate, both due to side reactions and to mechanical losses. The presence of substantial quantities of manganese and/or copper in the difficult-to-treat ores causes the consumption of substantial quantities of thiosulfate, and therefore it is essential to provide more thiosulfate during the lixiviation process. In such a case additional ammonium thiosulfate to make up for the losses is manufactured in situ by the reaction between extra sulfite, i.e. an amount of sulfite above and beyond that otherwise needed, and soluble sulfide. Additional thiosulfate can also be generated in situ by the use of elemental sulfur finely ground to give sufficient surface area.

Thus, at the conclusion of the recovery stage, ammonium thiosulfate may be internally manufactured in the liquor by the addition of extra sulfite, either as ammonium sulfite, or sulfur dioxide and ammonia, and the addition to the filtered liquor of soluble sulfide, preferably as ammonium polysulfide or ammonium sulfide or as elemental ground sulfur. Addition of the soluble sulfide will first precipitate metals from solution, and the remaining soluble sulfide will then react with sulfite to produce the desired thiosulfate. This technique can be used to restore only the thiosulfate lost during the prior lixiviation and/or recovery stage, or it can be used to bring the solution to the desired strength. The mechanism of the reaction is according to equation (2), above.

The use of soluble sulfides for in situ manufacture of thiosulfate has a secondary and important action; any divalent sulfur added (the polysulfide has both divalent and zero valent sulfur, while ammonium sulfide has only divalent sulfur) will first result in the precipitation of silver, gold, copper, iron, manganese, arsenic, antimony and other metals in solution that will form stable metal sulfides. The use of such soluble sulfides is one of the preferred methods for recovering from solution the precious metals and to recover copper for recycle in the process. It will also precipitate the undesirable metals which also serves to clean up the recycling solution.

In the metal precipitation step to recover the precious metals, it may be most desirable to precipitate only the gold and silver, leaving the copper in the solution to be recycled for reuse. To accomplish this objective, the use of metallic copper as precipitant has been tested and proven to be very effective for providing an essentially clean precious metal concentrate, and this procedure has the advantage that no deleterious elements are added, as when other metals, e.g. metallic zinc, are used to precipitate the precious metals. In contrast the use of metallic copper adds a desirable element and the amount added in this manner may be sufficient to maintain the desired concentration of this important component.

A beneficial effect is sometimes provided by the use of air in the leach process. Each different ore presents a different requirement which appears to be related to the oxidizing or reducing characteristics of the mineral it contains. Each individual ore needs to be tested with and without aeration both before being contacted by the leach liquor and during the leaching process. Some ores are benefitted, others indicating no effect and others indicate a loss in recovery. It needs to be kept in mind that aeration can also cause loss of thiosulfate by oxidation, which may be the cause of the detrimental effect in some instances.

The manufacture of thiosulfate in situ is an important consideration because, while thiosulfate is consumed, ammonia is not decomposed or otherwise lost, except for physical losses due to imperfect washing of the tails and/or vapor losses from the system. A well engineered and operated plant will experience very low losses of ammonia; therefore, if outside manufactured ammonium thiosulfate is added for make-up instead of in situ generated thiosulfate as is preferred, there will be a build-up of ammonia in the system in the amount of that added with makeup thiosulfate from such outside sources.

Thus, assuming good plant design to minimize ammonia losses, the preferred method for in situ make-up is to recycle ammonia in the system, and add elemental sulfur and sulfur dioxide in an amount of sufficient to undergo the following representative equation:

$$2NH_3+SO_2^{--}+SO+H_2O \rightarrow (NH_4)_2S_2O_3 \quad (4)$$

Because the reaction proceeds very slowly, an excess of sulfur should be present. The elemental sulfur in the unground state may be mixed with the ore ahead of the grinding system thereby obtaining the desired fineness in grinding with the ore for the required reactivity. Sulfur dioxide may be stage added throughout the leaching system, or it may be added in a single step into the recycle liquor after filtration and before grinding, or it may be added in a single step to the slurry coming from the grinding operation on its way to the leaching system. As previously stated, the pH should be regulated so that some free ammonia is always present to avoid acid conditions.

The sulfate ion ($SO_4^{--}$) is neutral in this leaching system, however, it is a decomposition product in the oxidation of thiosulfate, therefore, it could build up and adversely affect the activity of the solution. A small addition of lime is recommended if such a buildup should occur, thereby causing its precipitation as gypsum whereby it will be removed with the leached tails.

The following examples will illustrate the manner in which the invention can be practiced. It is to be understood that the specific conditions set forth in the examples are not to be considered limiting to the invention.

EXAMPLE 1

A manganese containing ore from the State of Sonora, Mexico, in the Guereguito region, was obtained, the ore having the following assay: gold 0.014 oz. per ton; silver 12.1 oz. per ton; manganese 2.1% per ton. This is a very difficult-to-treat ore, the owner having attempted for many years without success to have the ore commercially treated to recover the gold and silver.

The ore was split into seven equal parts of 500 grams each. The first 500 gram portion of the lot was ground fifteen minutes in a solution containing 200 grams of ammonium thiosulfate, 12 grams of ammonium sulfite, 50 grams of ammonium hydroxide and sufficient water to bring the solution to ½ liter. After grinding in this solution, the slurry was transferred to a 2,000 ml beaker along with additional water, added while washing the mill, to bring the total to 1,200 cc. This was placed on a hotplate with stirring and the temperature raised and maintained while stirring to between 50° and 60° C. After 1½ hours of this heating and stirring, sufficient copper sulfate was added to make 4 grams per liter of copper in solution. Stirring and heating continued for an additional six hours, adding every hour an additional amount of ammonium hydroxide to maintain the volume at a total of 1,200 cc. At the end of this period the slurry was filtered and the solids washed twice with 250 cc of water, after which the solids were dried and sent for assay.

The solution from the above test was analyzed for free ammonia, ammonium thiosulfate and sulfite ion, as well as for precious metals content. Sufficient ammonium sulfide was added to this solution to precipitate the silver content only, according to the following equation:

$$AG_2S_2O_3+(NH_4)_2S \rightarrow Ag_2S+(NH_4)_4S_2O_3$$

If there is any lead in the solution which has been leached from the ore, it too would be precipitated along with the silver and therefore additional sulfide to precipitate the lead must be added in order to precipitate the silver. Some copper also precipitates and some silver will remain in the solution. However, if 80% of the silver is precipitated and the residual solution containing a little silver but most of the copper is recycled to the process, reagent costs are kept low.

After removing the silver precipitate, the leaching solution was recycled to the second 500 gram lot of ore, and the above precedure repeated adding only sufficient ammonium thiosulfate, ammonium sulfite and copper to maintain optimum strength of the solution. Anhydrous ammonia was used in all cycles subsequent to the first, instead of ammonium hydroxide, so as to be able to use more water and better wash the values from the leached solids.

For this series, the solution analysis was brought back with each cycle to the approximate analysis as follows:

| | |
|---|---|
| Ammonium thiosulfate | 18% |
| Ammonium sulfite | 3% |
| Ammonium hydroxide | 2% |
| Copper about 4 grams per liter | |

This process was continued as above for the seven cycles with an average of 93.2% recovery for the silver and 86.7% of the gold. Consumption was approximately eight pounds of ammonium thiosulfate and three pounds of ammonium sulfite per ton of ore. Copper loss was about a pound per ton.

It is therefore seen that excellent results were achieved demonstrating the successful and economical recovery of gold and silver from this difficult-to-treat manganese containing ore.

EXAMPLE 2

Six different "difficult" ores as identified in Table I below were split into duplicate 500 gram samples, and two series of lixiviations were carried out, each series with one of the duplicates from each of the six samples. The A series of samples were treated in accordance with the present invention with 180 grams of ammonium thiosulfate, plus 9 grams of ammonium sulfite, and 4 grams of copper (as copper sulfate) and made up with water to one liter of slurry. The B series were treated with precisely the same leaching liquor, except that no sulfite was used.

TABLE I

| NAME AND ASSAY | A SERIES | | | | B SERIES | | | |
|---|---|---|---|---|---|---|---|---|
| | Solution | | Solids (Tails) | | Solution | | Solids (Tails) | |
| Au and Ag Oz/ton<br>Others as percent | % thio-sulfate | % Sulfite | Assay oz/t | Percent Recovery | % thio-sulfate | % sulfite | Assay oz/t oz/t | Percent Recovery |
| (1) Belmont Ore<br>Au 0.002<br>Ag 10.10<br>Mn 22.4% | 18.4 | 1.3 | 0.002 Au<br>1.80 Ag | None Au<br>82.2% Ag | 17.3 | Nil | 0.002 Au<br>5.78 Ag | None Au<br>42.8% |
| (2) PROSPECTO - Mexico<br>Au 0.079<br>Ag 12.0<br>Mn % 2.1<br>Cu % 1.1% | 19.7 | 0.9 | 0.004 Au<br>1.98 Ag | 95.0% Au<br>83.5% Ag | 18.6 | Nil | 0.050 Au<br>8.70 Ag | 36.7% Au<br>27.5% Ag |
| (3) Noranda 2062<br>Au 0.008<br>Ag 12.0<br>Mn % 18.0<br>Cu % 2.0 | 17.7 | 1.4 | 0.004 Au<br>0.56 Ag | 50.0%<br>95.3% | 17.5 | Nil | 0.006 Au<br>4.40 Ag | 25%<br>63.3% |
| (4) Guanacevi Mexico<br>Au oz/t 0.020<br>Ag. oz/t 5.3<br>Mn % 7.3 | 18.8 | 0.8 | 0.040 Au<br>0.20 Ag | 80.0%<br>96.2% | 18.2 | Nil | 0.014 Au<br>2.80 Ag | 30%<br>47.2% |

TABLE I-continued

| NAME AND ASSAY | A SERIES | | | | B SERIES | | | |
|---|---|---|---|---|---|---|---|---|
| | Solution | | Solids (Tails) | | Solution | | Solids (Tails) | |
| Au and Ag Oz/ton Others as percent | % thio-sulfate | % Sulfite | Assay oz/t | Percent Recovery | % thio-sulfate | % sulfite | Assay oz/t oz/t | Percent Recovery |
| (5) Cruz de Mayo Mexico | | | | | 16.4 | Nil | 0.012 Au | Zero |
| Au oz/t 0.012 | 19.3 | 0.70 | 0.006 Au | 50.0% | | | 6.22 Ag | 5.8% |
| Ag. oz/t 12.9 | | | 2.02 Ag | 84.3% | | | | |
| Mn % 0.90 | | | | | | | | |
| (6) Duval Corp. - Battle Mountain | | | | | 17.2 | Nil | 0.004 Au | 95.5% |
| | | | | | | | 0.05 Ag | 90.0% |
| Au oz/t 0.088 | 18.0 | 1.0 | 0.004 Au | 95.5% | | | | |
| Cu. % 0.3% | | | 0.02 Ag | 96.0% | | | | |

The samples were all placed on a heated agitator and 4 grams of copper were added to each slurry while injecting ammonia to bring the pH to 9.0 and the temperature to 50° C. Every two hours throughout the eight hour leaching, a sample was taken from the solution and in the case of the A series sufficient ammonium sulfite was added to maintain the sulfite analysis at about 1%. Ammonia was also added to maintain the pH above 7.5.

The results are given in Table I in which the identification of the ore is given in the left hand column with the gold and silver assays being presented in ounces per ton, and the other important ingredients are given in percent; gold and silver recoveries are reported in the two series.

EXAMPLE 3

A series of five consecutive runs were conducted, the last four involving the reuse of the pregnant liquor from the preceding run, and all five runs utilizing throughout as the reagents only sulfur dioxide, ammonia gas, elemental sulfur and cupric sulfate. These runs were carried out to determine the effectiveness of in situ production of thiosulfate in leaching silver from a refractory high manganese ore, the ore sample being one from Mexico containing 16.1 oz. of silver per ton, and 10.5% manganese.

The first leach in the series was made using 500 grams of −10 mesh ore mixed with 60 grams of elemental sulfur, the mixture being ground in a laboratory ball mill in 400 grams of water. The ground mixture was removed to an open beaker and sufficient water added to provide a total of 1 liter; 30 grams of cupric sulfate were then added, and agitation was started while ammonia was injected to continuously maintain some free ammonia and also maintain the pH at a level of about 9.0. At the same time, sulfur dioxide gas was added rapidly at first, and then at a declining rate over a period of 1 hour at which time a measured 90 grams of sulfur dioxide had been added.

Table II below gives the recovery as calculated from the tail analysis and gives the analysis of the pregnant liquor filtered from the leach cycle. The recovery of silver was satisfactory and the pregnant liquor indicates almost complete conversion of the sulfite ion to thiosulfate by its reaction with the added sulfur. Throughout these runs, an excess of elemental sulfur was added. However, if such a loss of sulfur with the tails is considered to be of economic consequence, then it is possible to add a flotation step to recover this sulfur just before the filter step, as elemental sulfur is a natural floater. In one test with only air and no other additives, the sulfur was recovered by flotation for reuse.

The second and subsequent runs 2 through 5 were all made by grinding the ore and elemental sulfur in the ball mill as before, but using the pregnant liquor from the immediately previous run in the grind and adding only enough wash water from the previous runs to bring the total to 1 liter, such make-up being added in the agitated leach. Because the pregnant liquor recycled from the immediately previous run already contained substantial reagents, the quantity of reagents added, i.e. the quantity of sulfur dioxide and cupric sulfate, was cut in half compared to the first run, so that 45 grams of sulfur dioxide and 15 grams of cupric sulfate were added in each of runs 2 through 5. This represents a high rate of reagent consumption which occurs because of the large of quantity of manganese present in the ore; however, production of the sulfur dioxide by burning sulfur does not constitute an unreasonable cost, considering that such high manganese ores had previously not been treatable.

The results are shown in Table II below.

TABLE II

| | Tails | | Pregnant Liquor | | | |
|---|---|---|---|---|---|---|
| Run No. | Oz./Ton Assay Silver | Re-covery Per-cent | Free Ammo-nia | Ammo-nium Thiosul-fate | Sulfite as $SO_3^=$ | Assay Silver Oz/Ton |
| 1 | 1.6 | 90.1 | 3.7 | 8.3 | 0.07 | 10.5 |
| 2 | 2.9 | 82.0 | 4.1 | 10.3 | 0.07 | 15.8 |
| 3 | 2.7 | 83.3 | 3.8 | 11.2 | 0.09 | 20.2 |
| 4 | 3.52 | 78.4 | 2.2 | 10.9 | 0.20 | 25.6 |
| 5 | 2.92 | 81.9 | 3.3 | 11.2 | 0.15 | 27.4 |

It will be obvious to those skilled in the art that various changes may be made without departing from the scope of the invention and the invention is not to be considered limited to what is described in the specification.

What is claimed is:

1. In a method for the recovery of precious metals including gold and silver from an ore containing same, comprising lixiviating said precious metals from said ore using an ammonium thiosulfate liquor as the lixiviating agent in the presence of copper, followed by recovering said precious metals from said ammonium thiosulfate liquor, the improvement comprising:

maintaining the pH of said liquor during lixiviation at a value of at least 7.0 with ammonia, and simultaneously maintaining a sulfite ion concentration of at least 0.05%, by generation in situ by the addition of sulfur dioxide, and generating thiosulfate in situ as needed by the addition of elemental sulfur to the system.

2. A method in accordance with claim 1, wherein said ore is a manganese containing ore.

3. A method in accordance with claim 1, wherein said ore contains at least 0.5% manganese and said sulfite ion concentration is maintained at 1–4%.

4. A method in accordance with claim 1, wherein the temperature is maintained at 40°–60° C.

5. A method in accordance with claim 1, wherein after said recovery of said precious metals, said ammonium thiosulfate liquor is recycled and additional thiosulfate is generated in situ by adding extra sulfite and elemental sulfur in quantities sufficient to react and thereby maintain the thiosulfate requirements of the method, and reacting the same to form the additional thiosulfate.

6. A method in accordance with claim 5, wherein said added extra sulfite is provided by adding to the liquor sulfur dioxide, the quantities of sulfur dioxide and elemental sulfur being sufficient to react to thereby maintain the thiosulfate and sulfite requirements of the method.

* * * * *